US009147312B2

(12) United States Patent
Kammler

(10) Patent No.: US 9,147,312 B2
(45) Date of Patent: Sep. 29, 2015

(54) METHOD AND SYSTEM OF DISTRIBUTING PROGRESSIVE GAMING

(75) Inventor: Keith Kammler, Las Vegas, NV (US)

(73) Assignee: Aristocrat Technologies Australia Pty Limited (AU)

( * ) Notice: Subject to any disclaimer, the term of this patent is extended or adjusted under 35 U.S.C. 154(b) by 797 days.

(21) Appl. No.: 12/402,963

(22) Filed: Mar. 12, 2009

(65) Prior Publication Data

US 2009/0233707 A1 Sep. 17, 2009

Related U.S. Application Data

(60) Provisional application No. 61/036,331, filed on Mar. 13, 2008.

(51) Int. Cl.
*A63F 9/24* (2006.01)
*G07F 17/32* (2006.01)

(52) U.S. Cl.
CPC ..... *G07F 17/3227* (2013.01); *G07F 17/32* (2013.01)

(58) Field of Classification Search
CPC ..... G07F 17/3227; G07F 17/32
USPC ..... 463/16–25, 27, 30
See application file for complete search history.

(56) References Cited

U.S. PATENT DOCUMENTS

| | | | | |
|---|---|---|---|---|
| 5,508,754 | A * | 4/1996 | Orphan | 348/722 |
| 5,543,852 | A | 8/1996 | Yuen et al. | |
| 5,627,602 | A | 5/1997 | Nio et al. | |
| 5,822,425 | A | 10/1998 | Ezaki et al. | |
| 5,995,709 | A | 11/1999 | Tsuge | |
| 6,895,166 | B1 | 5/2005 | Shriebman | |
| 2001/0026279 | A1 | 10/2001 | Asano | |
| 2001/0030710 | A1 | 10/2001 | Werner | |
| 2002/0129381 | A1 | 9/2002 | Barone et al. | |
| 2003/0007096 | A1 | 1/2003 | Katayama et al. | |
| 2003/0142959 | A1 | 7/2003 | Qu | |
| 2004/0036801 | A1 | 2/2004 | Katayama et al. | |
| 2004/0070973 | A1 | 4/2004 | Lee | |
| 2005/0177856 | A1 | 8/2005 | Lee | |
| 2005/0278747 | A1 | 12/2005 | Barton et al. | |
| 2006/0064644 | A1 | 3/2006 | Joo | |
| 2007/0019108 | A1 | 1/2007 | Park et al. | |
| 2007/0030966 | A1 | 2/2007 | Sra et al. | |
| 2007/0060314 | A1 | 3/2007 | Baerlocher et al. | |
| 2007/0130581 | A1 | 6/2007 | Del Sesto et al. | |
| 2007/0288969 | A1 * | 12/2007 | Prum | 725/81 |

FOREIGN PATENT DOCUMENTS

| | | |
|---|---|---|
| CA | 1199399 | 1/1986 |
| CA | 2551272 | 3/1997 |
| CN | 1571030 | 1/2005 |
| CN | 1714571 | 12/2005 |

(Continued)

*Primary Examiner* — Vongsavanh Sengdara
(74) *Attorney, Agent, or Firm* — McAndrews, Held & Malloy, Ltd.

(57) ABSTRACT

A system for distributing progressive gaming related information comprises a combiner and a communications medium. The combiner is for inserting data indicative of progressive gaming related information into a video signal as closed caption data to produce a combined video signal. The communications medium is for distributing the combined video signal to one or more receivers for display of a video image which comprises the progressive information as closed caption text.

12 Claims, 6 Drawing Sheets

(56) References Cited

FOREIGN PATENT DOCUMENTS

| | | |
|---|---|---|
| CN | 1777252 | 5/2006 |
| EP | 0874522 | 10/1998 |
| EP | 1809028 | 7/2007 |
| FR | 2680440 | 2/1993 |
| GB | 1145926 | 3/1969 |
| GB | 1532116 | 11/1978 |
| GB | 2114407 | 8/1983 |
| JP | 61118575 | 6/1986 |
| JP | 61226311 | 10/1986 |
| JP | 63016112 | 1/1988 |
| JP | 63266288 | 11/1988 |
| JP | 1256060 | 10/1989 |
| JP | 1271298 | 10/1989 |
| JP | 2061860 | 3/1990 |
| JP | 2120183 | 5/1990 |
| JP | 6261260 | 9/1994 |
| JP | 7212698 | 8/1995 |
| JP | 7212699 | 8/1995 |
| JP | 8065644 | 3/1996 |
| JP | 8321979 | 12/1996 |
| JP | 9154096 | 6/1997 |
| JP | 9320155 | 12/1997 |
| JP | 2000156848 | 6/2000 |
| JP | 2001008077 | 1/2001 |
| JP | 2001069439 | 3/2001 |
| JP | 2002044616 | 2/2002 |
| JP | 2002320207 | 10/2002 |
| JP | 2002325218 | 11/2002 |
| JP | 2003249946 | 9/2003 |
| JP | 2004215033 | 7/2004 |
| JP | 2004279848 | 10/2004 |
| JP | 2004343488 | 12/2004 |
| JP | 2005203863 | 7/2005 |
| JP | 2006337702 | 12/2006 |
| KR | 20030017939 | 3/2003 |
| KR | 20030040631 | 5/2003 |
| KR | 20040024833 | 3/2004 |
| KR | 20040083705 | 10/2004 |
| KR | 20040092788 | 11/2004 |
| KR | 20050015182 | 2/2005 |
| MX | PA04010509 | 8/2005 |
| WO | 9735436 | 9/1997 |
| WO | 9827728 | 6/1998 |
| WO | 0067472 | 11/2000 |
| WO | 0122729 | 3/2001 |
| WO | 0182585 | 11/2001 |
| WO | 03049433 | 6/2003 |
| WO | 2004015492 | 2/2004 |
| WO | 2005069617 | 7/2005 |
| WO | 2007064340 | 6/2007 |

* cited by examiner

METHOD AND SYSTEM OF DISTRIBUTING PROGRESSIVE GAMING

RELATED APPLICATIONS

This application claims priority to U.S. Provisional Patent Application No. 61/036,331 having a filing date of Mar. 13, 2008, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Casinos and gaming venues often have a progressive jackpot running, which is where an accumulating prize pool is available to be won when a certain game outcome is achieved. It is desirable for the amount of the cumulative progressive jackpot prize pool, winning information and other messages to be told to game players. Sometimes it is desirable to distribute this sort of information inside the gaming floor as well as outside of the gaming floor, such as into a sports bar within the same complex.

BRIEF SUMMARY OF THE INVENTION

According to a first aspect of the present invention there is provided a method of distributing progressive gaming related information, comprising:

inserting data indicative of progressive information from a gaming system into a video signal as closed caption data to produce a combined video signal; and distributing the combined video signal to one or more receivers for display of a video image which comprises the progressive information as closed caption text.

In an embodiment the method further comprises receiving data indicative of the progressive information from a gaming system. In an embodiment the received data is extracted from a data signal.

In an embodiment the progressive information comprises one or more of: Jackpot information, game results, congratulatory messages for game winners, and game scheduling information.

In an embodiment the method further comprises displaying the combined video image according to the video signal.

In an embodiment the method comprises receiving the video signal from a video signal source.

According to a second aspect of the present invention there is provided a system for distributing progressive gaming related information comprising:

a combiner arranged to combine data indicative of progressive gaming related information with a video signal so as to produce a combined video signal comprising the progressive gaming related information in the form of closed caption data;

a communications medium for distributing the combined video signal to one or more receivers for display of a video image which comprises the progressive gaming related information as closed caption text.

In an embodiment the system further comprises a source of the data indicative of progressive gaming related information.

In an embodiment the source forms the gaming related information in a format suitable for insertion into the video signal as closed caption text prior to outputting the data indicative of progressive gaming related information to the combiner.

In an embodiment the combiner is configured to process the data indicative of progressive information so as to extract the progressive information for insertion into the video signal.

In an embodiment the source forms the data indicative of progressive information in a format suitable for insertion as close caption text.

In an embodiment the system comprises a source of the video signal.

In an embodiment the system comprises one or more receivers, the or each receiver comprising a display for displaying the video image according to the combined video signal.

According to a third aspect of the present invention there is provided logic embodied in a processor readable form which when executed controls the processor to perform a method of distributing progressive gaming related information, comprising:

inserting data indicative of progressive information from a gaming system into a video signal as closed caption data to produce a combined video signal; and distributing the combined video signal to one or more receivers for display of a video image which comprises the progressive information as closed caption text.

BRIEF DESCRIPTION OF SEVERAL VIEWS OF THE DRAWINGS

The present invention will now be described, by way of example only, with reference to the accompanying drawings, in which.

DETAILED DESCRIPTION OF THE INVENTION

In an embodiment of the present invention a system for distributing progressive gaming related information comprises a combiner for inserting data indicative of progressive gaming related information into a video signal as closed caption data to produce a combined video signal; and a communications medium for distributing the combined video signal to one or more receivers for display of a video image which comprises the progressive information as closed caption text.

In an embodiment a source of the data indicative of the progressive information is a gaming system.

Figure 6:
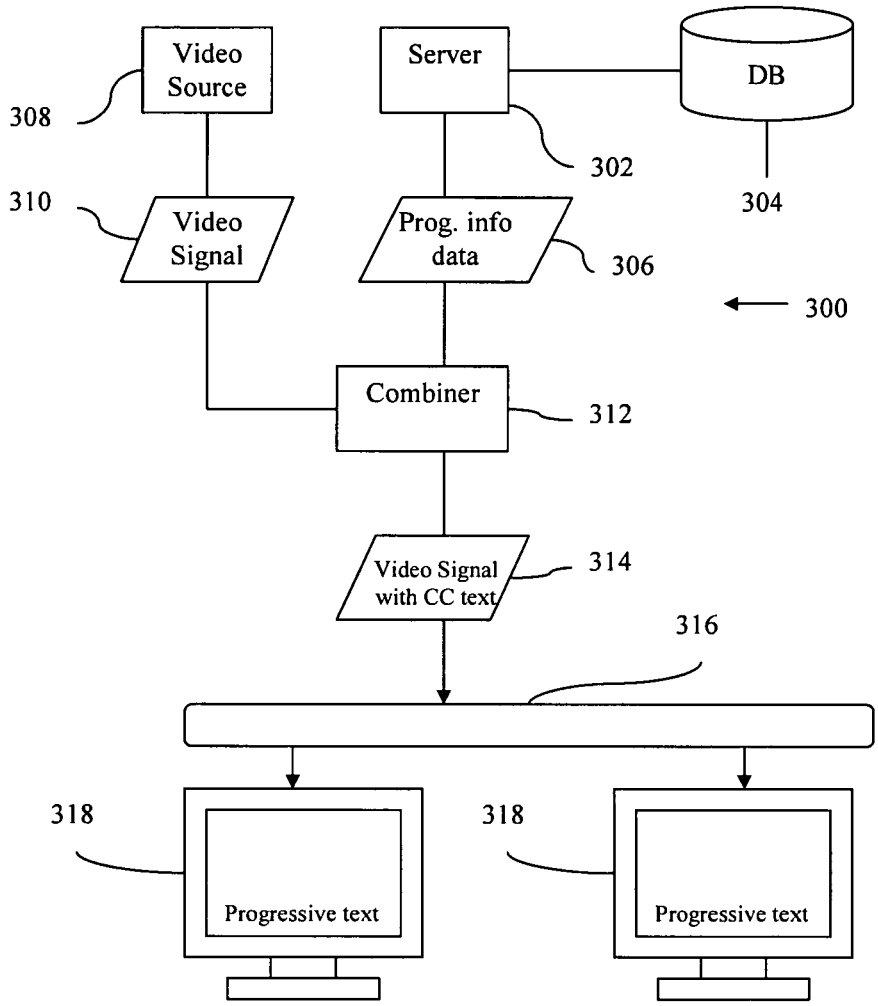
FIG. 6 is a schematic plan view of a gaming system according to an embodiment of the present invention.

Referring to FIG. 6 there is shown a system 300 for distributing progressive gaming related information, which comprises a source of progressive gaming information, video source 308, combiner 312, communication medium 316 and one or more displays 318. In an embodiment the source of progressive gaming information is in the form of a gaming system server 302. The server 302 may be a server which controls and monitors a progressive jackpot or a server which receives information regarding the progressive jackpot from a jackpot controller. The progressive gaming related information may be stored in a database 304. The server 302 accesses database 304 to obtain the progressive gaming related information, such as a cumulative Jackpot prize pool, winning information such as bingo or Keno numbers or information on winners of games. Other information such as progressive amounts, win notifications/congratulations, or other messages can be output from the server 302. Such information is in the form of text and is encoded in a data signal 306 indicative of this information. The server 302 outputs the data signal 306 to the combiner 312. In an embodiment the information is formatted using a suitable protocol, such as GDAP, SAS, G2S, or XML to form the data signal 306. Further, the text information may be formatted in a non-human readable form which can be subsequently converted into readable text by the combiner 312.

The video source 308 produces a digital or analog video signal 310. The video signal may be in one of any suitable format, such as modulated, unmodulated, digital, NTSC, ATSC, HD, PAL etc. The source may be for example a broadcast television receiver, a video cassette recorder, a DVD player or another form of suitable video player. The video signal may be any suitable image such as video of a sporting event or casino related promotional materials. The video source 308 provides the signal 310 to the combiner 312.

The combiner 312 is configured to receive the data signal 306 and, if necessary, process it into the text information. The combiner 312 also inserts the text information into the video signal as closed captioned (CC) text, thereby producing a video signal with CC text 314. The CC text video signal 314 is provided to a communication medium 316 for distribution to the displays 318. A communication medium 316 may be for example coaxial cable or a suitable data cable or in a wireless format. The displays 318 may be for example, television sets, video projectors or video monitors (CRT, LCD or plasma screen) located at the gaming machine such in the top box, in a separate video display such as one associated with a player tracking module, at a bank display over a bank of machines or at video displays distributed throughout the casino. Each display 318 displays a video image according to the video signal and converts the combined CC text embedded within a video signal into progressively displayed text 320 over the video image.

In an embodiment the combiner 312 receives a plurality of video signals and the same information is inserted into each video signal. Alternatively a different set of information, or differently timed information, is inserted in each video signal. In an embodiment the gaming related information is provided from a plurality or sources and can be converted from a plurality of formats into the text for insertion in the video signal.

In an embodiment if the video signal already has closed caption information present, the information from the server is inserted in addition to the existing information. In an alternative the information from the server replaces the existing information.

The information may be inserted into the video signal using a format that is decodable and/or presentable by a downstream display device.

In an embodiment the information is inserted as Closed Caption text in line 21 of the video signal, that is, the last horizontal line before video information starts. In an embodiment the display 318 is capable of displaying standard Closed Caption text as described in the United States of America Federal Communication Commission Rules under Title 47 CFR Part 15, Section 15.119 (also known as FCC 15.119), which is incorporated herein by reference.

The combiner 312 may be capable of script operation or more elaborate presentation of the progressive information or advertising, as to colour, font, size, location, background etc. In this embodiment the data signal 306 from the server 302 may also have embellishment information for the combiner 312 to process and apply to the text.

In an embodiment the combiner 312 is a processor controlled by logic in the form of firmware or computer software. In an embodiment the combiner 312 also comprises working memory. In an embodiment the combiner 312 is in the form of a computer running a computer program in memory for controlling the computer to operate as the combiner and to perform the functions of the combiner. The software may be embodied in a computer readable form, such as a disk, CD, DVD, volatile or non-volatile memory (such as RAM or flash memory) or a mass storage device, such as a hard disk drive.

Figure 7:
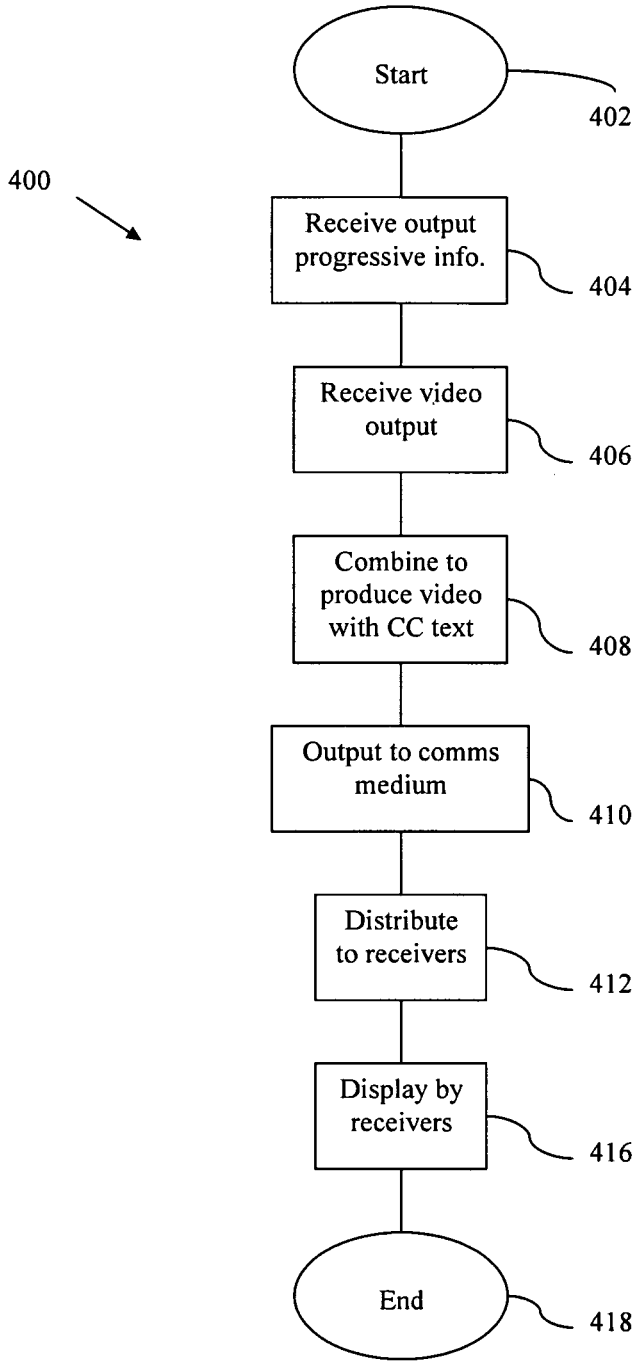
FIG. 7 is a schematic side elevation of the gaming system of FIG. 6.

Referring to FIG. 7, there are shown a method 400 for distributing progressive gaming related information, which commences at 402, and in an embodiment is performed by the system 300. Output data signal 306 is received 404 from the server 302. Output video signal 310 is received 406 from the video source 308. The progressive information is extracted from the data signal 306. The progressive information and video signal 310 are combined 408 to produce a video signal with embedded CC text 314. The combiner 312 outputs 410 the combined signal 314 to the communication medium 316. The communication medium 316 distributes 412 the combined signal 314 to the receivers decode the combined signal to produce the image according to the video signal. The image is overlaid with the progressive text in the CC component of the combined signal 314 and is displayed 416. The method ends at 418.

The source of progressive gaming related information may be one or more of the following gaming systems arranged to implement a probabilistic wagering game wherein a player wagers a bet amount and a prize is allocated to the player depending on a game result.

The game implemented by the gaming system operates such that a player places a bet on a game outcome and will be awarded a prize according to the result of the game and in some embodiments according to the amount wagered.

The outcome of the game is determined according to the rules of the specific implementation of the game and the related symbols.

Jackpots are commonly implemented in casinos. One form of Jackpot may be particular to a stand alone machine, where certain winning conditions trigger winning of the Jackpot for that machine. Another form of Jackpot is where a number (often all the machines of a certain type on the casino floor) contribute to the Jackpot total. Certain winning conditions trigger winning of the cumulative Jackpot total. A Jackpot may be a progressive monetary total or a fixed prize, such as fixed monetary amount or, for example, a car or holiday.

Figure 1:
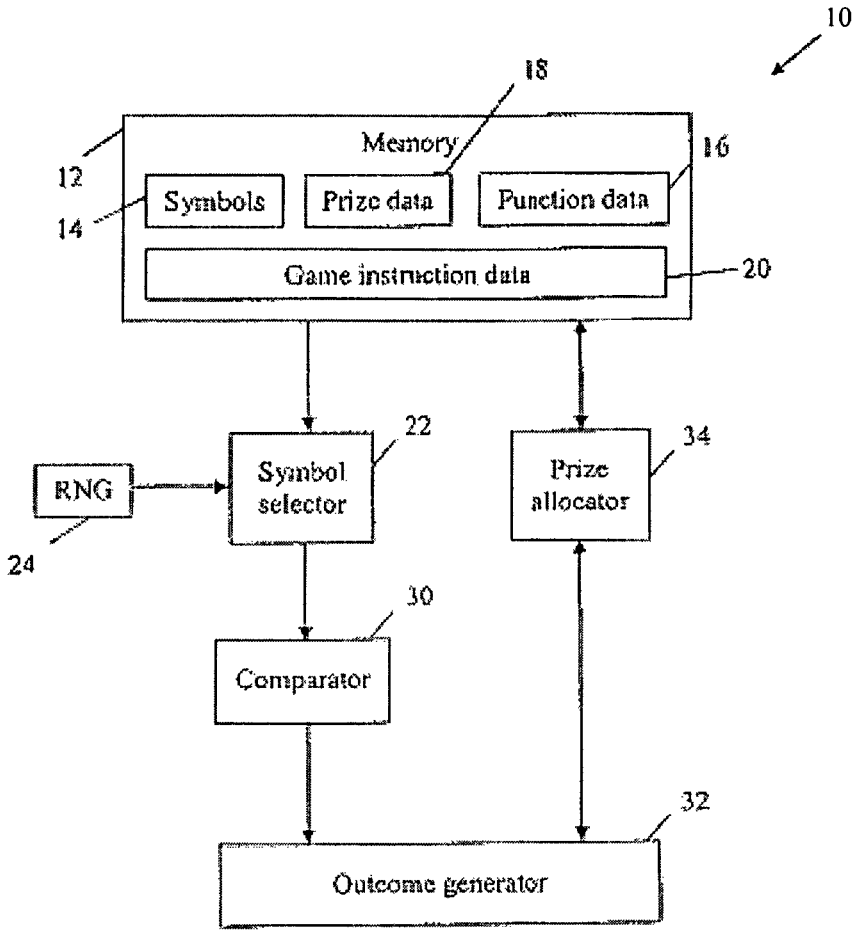
FIG. 1 is a diagrammatic block diagram of a gaming system in accordance with an embodiment of the present invention.

Referring to FIG. 1, a gaming apparatus 10 for implementing an electronic embodiment of the game is shown in diagrammatic form. The gaming apparatus 10 comprises a memory 12 arranged to store symbols data 14 indicative of a plurality of symbols for selection and display to a player during a game, function data 16 indicative of one or more functions associated with one or more of the symbols, prize data 18 indicative of prize amounts of the game, and game instruction data 20 indicative of game instructions usable by the gaming machine 10 to control operation of the game.

The gaming apparatus 10 also includes a symbol selector 22 which is arranged to randomly select symbols for display in the game. A random number generator 24 is used to determine which symbols of the selector 22 selects.

It will be appreciated that the random number generator 24 may be of a type which is arranged to generate pseudo random numbers based on a seed number, and that in this specification the term "random" will be understood accordingly to mean truly random or pseudo random.

The gaming apparatus 10 also comprises a comparator 30 arranged to compare the related symbols in accordance with the game instruction data 20, and an outcome generator 32 which in accordance with the game instruction data 20 determines whether the player is successful or unsuccessful and therefore wins a prize or not.

While in this example the comparator and the outcome generator are shown as separate components, it will be understood that the functions of the outcome generator and the comparator may be implemented by one component such as a micro-processor configured to have the memory, program instructions, and other components and software known in the art for operating and controlling a gaming machine.

The gaming apparatus 10 also comprises software and data stored to define a prize allocator 34 which communicates with the prize data 18 stored in the memory 12 and with the outcome generator 30, and determines the predetermined prize to award to a player obtaining a corresponding outcome such as symbols selected by the symbol selector 22 or combinations of symbols obtained after some interaction of the player with the game.

The gaming apparatus 10 may also be arranged such that a player has the option of choosing to continue with another round of the game and thereby attempt to wager the winnings of the previous round (parley his winnings)or to win a game in which the results of subsequent rounds determines he outcome of the game.

Instead of providing monetary prize amounts, the prize allocated to a player for reaching a level and/or any additional prize may be in the form of points, tokens, progressive prizes, eligibility for feature games, tournament entitlements, or special symbol entitlements in other games, such as an additional wild symbol for a predetermined number of games.

In the embodiment described below, the symbol selector 22, the comparator 30, the prize allocator 34 and the outcome generator 30 are implemented using a microprocessor and associated programs, although it will be understood that other implementations are envisaged.

The gaming apparatus 10 can take a number of different forms.

In a first form, a stand alone gaming apparatus 10 is provided wherein all or most components required for implementing the game are present in a player operable gaming machine. The outcome derived at the gaming machine 10 is not dependant upon interaction from any system connected to the gaming apparatus 10. The gaming machine 10 could accept wagers, render winning and losing outcomes and, inmost cases, pay awards issued to the players.

The stand alone gaming apparatus 10 may be the source of progressive gaming related information, which may be provided directly to the combiner 312 or it may be collated by the server 302.

In a second form, a distributed architecture is provided wherein some of the components required for implementing the game are present in a player operable gaming apparatus 10 and some of the components required for implementing the game are located remotely relative to the gaming apparatus. For example, a "thick client" architecture may be used wherein part of the game presentation is controlled at the gaming apparatus 10 and part of the game is controlled or influenced remotely, such as by a remote gaming server in communication with the gaming apparatus 10; or a "thin client" architecture may be used wherein most of the game is controlled or influenced remotely such as by a remote gaming server and a player operable gaming machine used only to display audible and/or visible gaming information to the player and receive gaming inputs from the player.

In this embodiment the gaming apparatus 10 or the remote gaming server may be the source of progressive gaming related information.

However, it will be understood that other arrangements are envisaged. For example, an architecture may be provided wherein a gaming machine is networked to a gaming server and the respective functions of the gaming machine and the gaming server are selectively modifiable. For example, the gaming apparatus may operate in stand alone gaming machine mode, "thick client" mode or "thin client" mode depending on the game being played, operating conditions, and so on. Other variations will be apparent to persons skilled in the art.

The results of each game may be reported to a slot accounting system server. Where gaming apparatus 10 are linked to a progressive jackpot, the gaming apparatus 10 may be linked in the foregoing manner for a system driven progressive jackpot or may be linked through a separate jackpot control device configured to monitor the wagers, allocate portions to one or more progressive jackpot pools and control display meters at the gaming machines 10 (or at common overhead displays) to display information as to the amount in each jackpot. The jackpot control device may be the source of progressive gaming related information.

In particular each gaming apparatus 10 may be configured (or selectively configurable by the player or casino) to link the gaming apparatus 10 to a progressive jackpot pool, where a proportion of the takings from each of a plurality of gaming machines are accumulated. When a player wins a game that meets predetermined jackpot winning criteria the player will win the accumulated "Jackpot" amount. The server or jackpot controller will keep track of the accumulated amount and can provide the current jackpot total. Where there are a large number of machines feeding the jackpot total can accumulate rapidly to very high awards of several millions. The rapid accumulation of this total can increase the excitement of playing a game in which the jackpot can be won.

Figure 2:
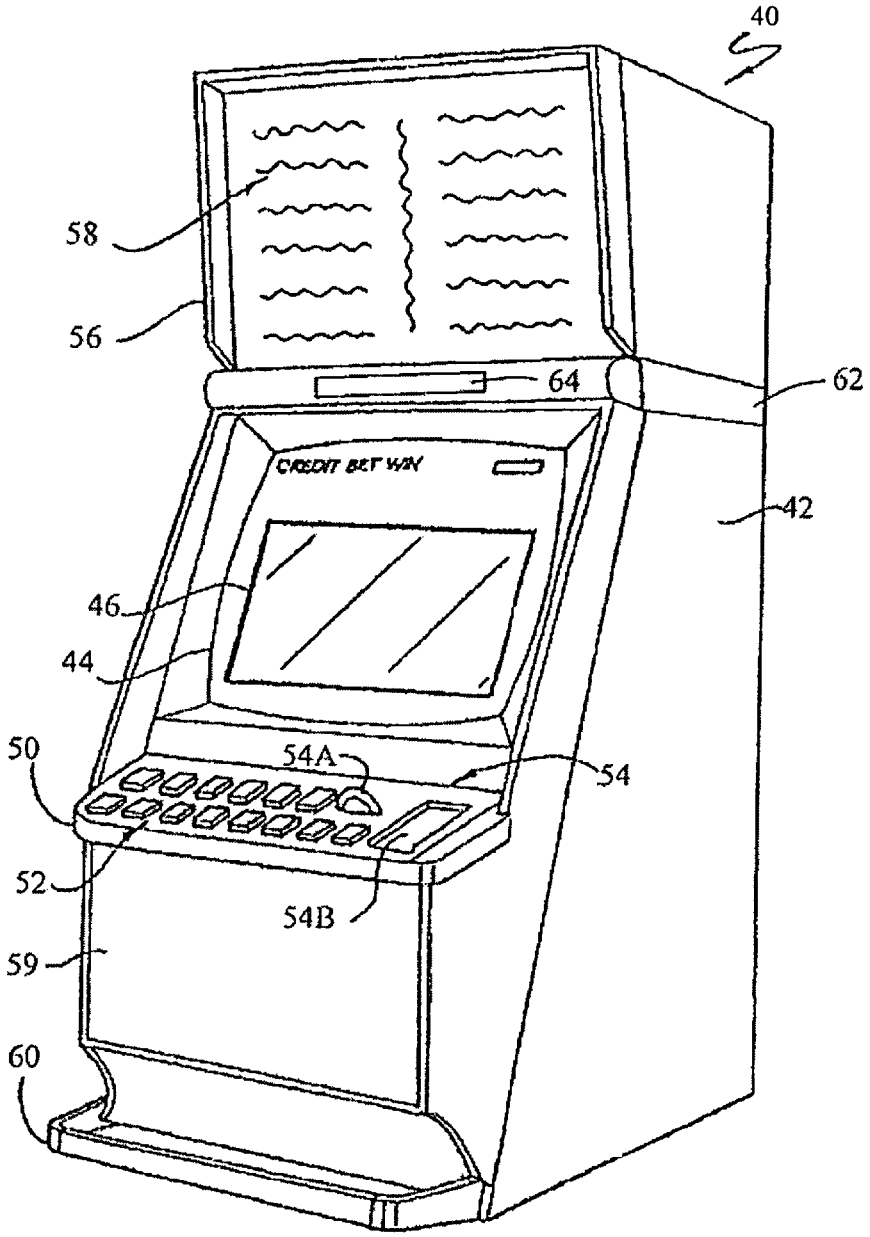
FIG. 2 is a diagrammatic representation of a gaming system in accordance with an embodiment of the present invention with the gaming system implemented in the form of a stand alone gaming machine.

A gaming apparatus in the form of a stand alone gaming machine 40 is illustrated in FIG. 2. The gaming machine 40 includes a console 42 having a display 44 on which is displayed representations of a game 46 that can be played by a player. A mid-trim 50 of the gaming machine 40 houses a bank of buttons 52 for enabling a player to interact with the gaming machine during game play, including enabling the player to select the bet amount and to provide other inputs. The mid-trim 50 also houses a credit input mechanism 54 which in this example includes a coin acceptor 54A and a bill collector 54B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card having a machine readable element or any other portable storage medium capable of being read by the reading device.

A top box 56 may carry artwork 58, including for example pay tables and details of bonus awards and other information or images relating to the game. Further artwork and/or information may be provided on a front panel 59 of the console 42. A coin tray 60 is mounted beneath the front panel 59 for dispensing cash payouts from the gaming machine 30.

The display 44 is in the form of a video display unit, particularly a cathode ray tube screen device. Alternatively, the display 44 may be a liquid crystal display, plasma screen, any other suitable video display unit. For an electro-mechanical stepper machine, the display 44 may be a glass for viewing a plurality of electro-mechanical reels. The top box 56 may also include a display, for example a video display unit, which may be of the same type as the display 44, or of a different type.

The display 44 in this example is arranged to display video representations of the selected game outcome of randomly selected and displayed game symbols. The outcome is often formatted as a three-by-five array of symbols corresponding to a game having five reels with three symbol positions for each. The display 44 may in some embodiments be used to display the video image which comprises the progressive gaming related information in the form of closed caption text.

The stand alone machine 40 may be networked to the slot accounting server or to a jackpot controller for purposes of contributing to the progressive jackpot total and for reporting game results. The stand alone machine 40 may also act as the source of progressive gaming related information.

Figure 3:
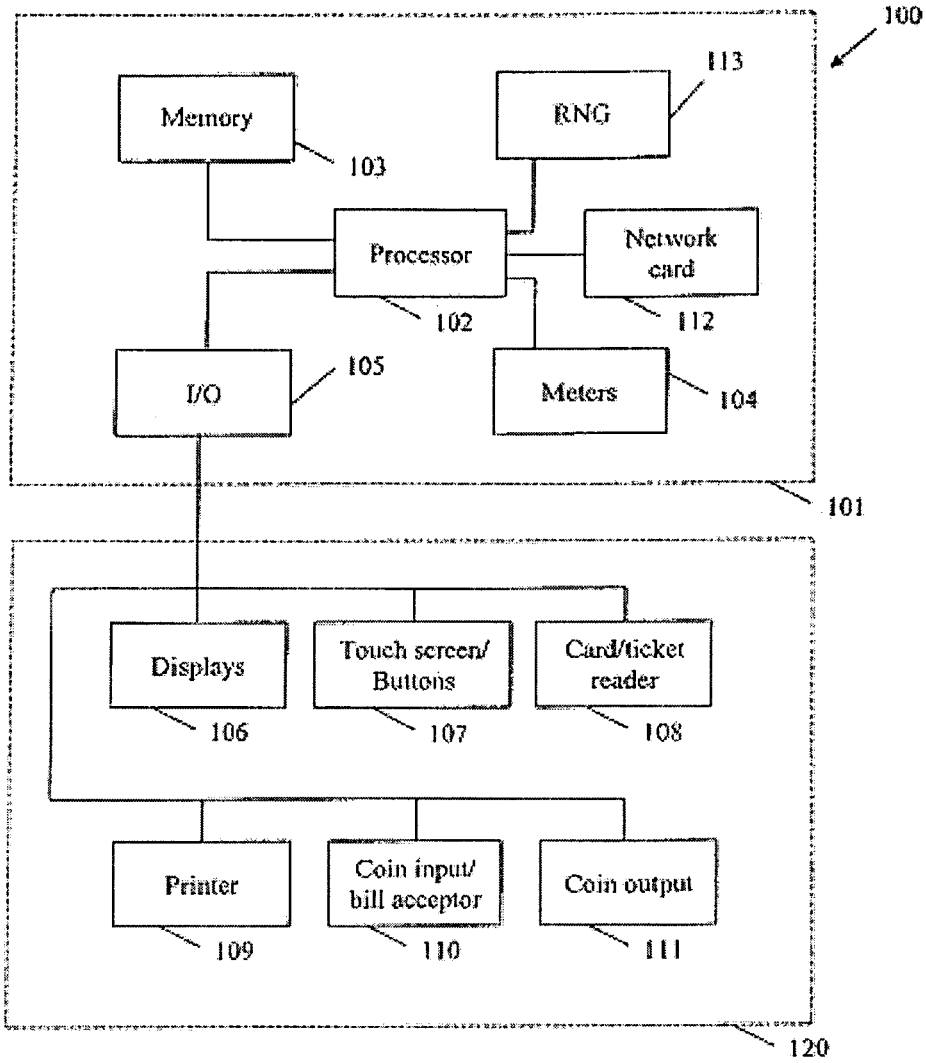
FIG. 3 is a schematic block diagram of operative components of the gaming machine shown in FIG. 2.

FIG. 3 shows a block diagram of operative components of a typical gaming machine 100 which may be the same as or different to the gaming machine 40 shown in FIG. 2.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 4:
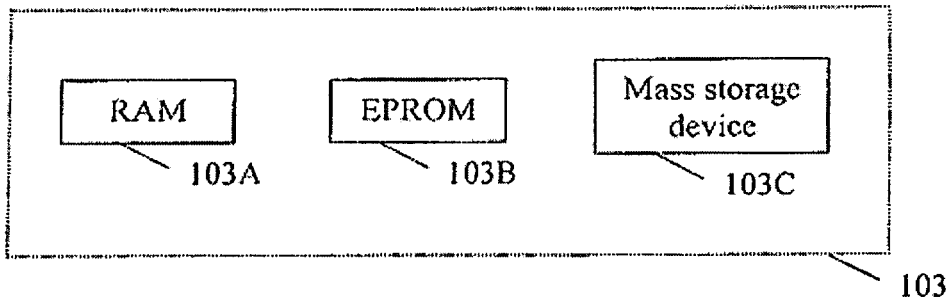
FIG. 4 is a schematic block diagram of components of a memory of the gaming machine shown in FIG. 2.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere, and data indicative of symbols, prize amounts and symbol functions used in the game.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 3, the peripheral devices that communicate with the game controller 101 comprise one or more displays 106, a touch screen display and/or bank of buttons 107, a card and/or ticket reader 108, a printer 109, a bill acceptor and/or coin acceptor 110 and a coin dispensing mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central slot accounting system server or database and receive data or commands from the slot accounting system server or database. The network card may also communicate with a jackpot controller of the type which allocates a percentage of the wagers from the linked gaming machines to one or more progressive jackpot pools, monitors play for jackpot winning outcomes and controls meters and displays associated with the progressive jackpot. The network card may also send the progressive gaming related information to the server 302 or directly to the combiner 312.

It is also possible for the operative components of the gaming machine 100 to be distributed, for example input/output devices 106,107,108,109,110,111 may be provided remotely from the game controller 101.

The gaming system may include a network, which for example may be an Ethernet network, a LAN or a WAN. In this example, banks of two gaming machines 100 are connected to the network. The game system includes connection to the slot accounting system and jackpot controller for accumulating jackpot totals.

Figure 5:
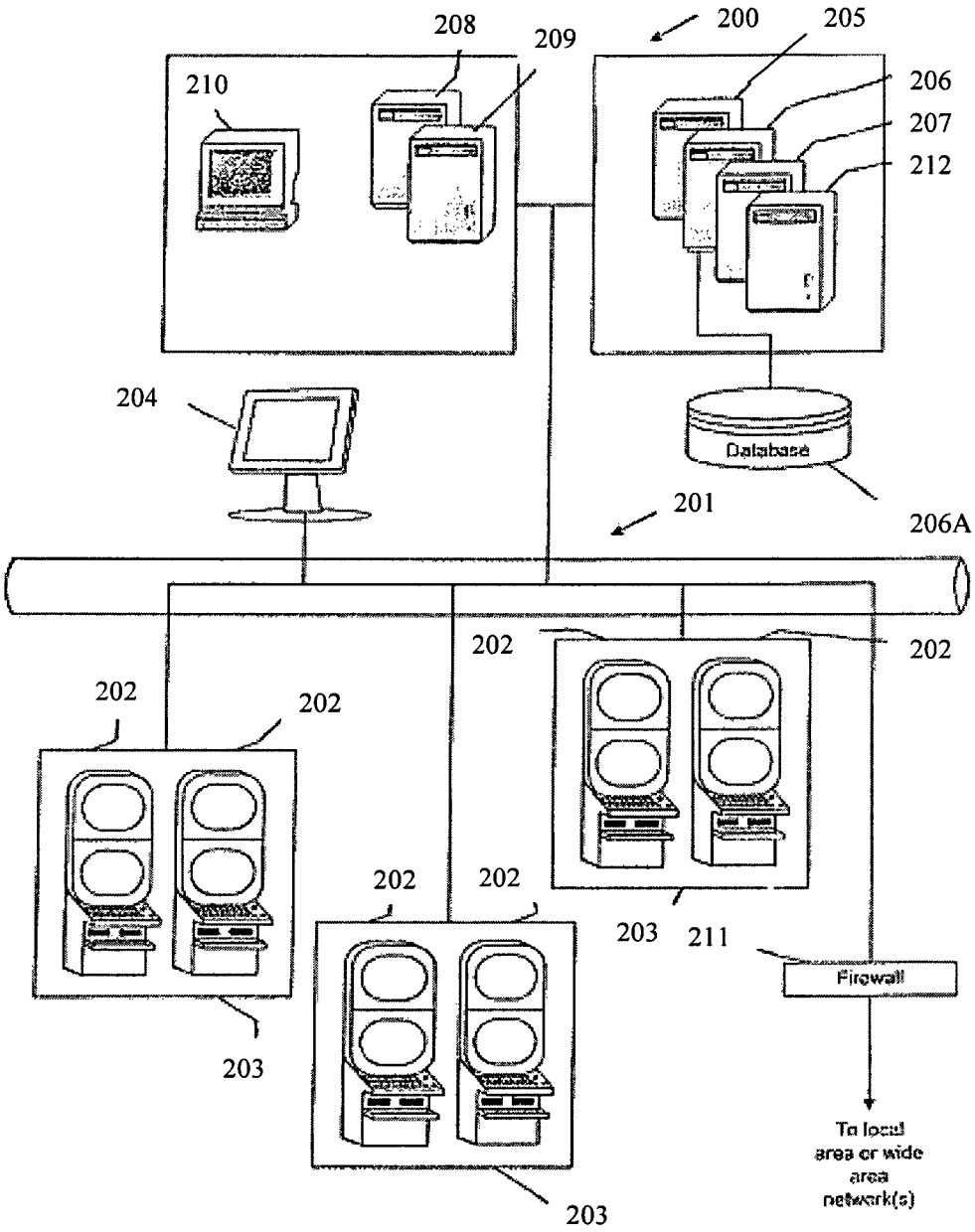
FIG. 5 is a schematic diagram of a gaming system in accordance with an alternative embodiment of the present invention with the gaming system implemented over a network.

FIG. 5 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 40,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines such as large overhead displays over the gaming machines 202 or displays in the top box 56 or game display 46 or a separate display such as provided with player tracking modules such as the Sentinel III module offered by Aristocrat Technologies, Inc. The displays 204 may be used to display representations associated with game play on the gaming machines 202, and/or used to display other representations, for example promotional or informational material.

The displays 204 may also, in addition to those described above, include separate displays 204 distributed throughout the casino such as near bars, in restaurants, in the sports book or the like. The displays 204 may be used to display the video image which comprises the progressive gaming related information as closed caption text.

In a thick client embodiment, a game server 205 implements part of the game played by a player using a gaming machine 202 and the gaming machine 202 implements part of the game including the random selection of the outcomes. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, when the gaming system enables players to participate in a progressive jackpot game, a jackpot controller 207 will be provided to monitor and carrying out of the jackpot accumulation, reporting, metering and display functions for the game. This jackpot controller may be a separate device or may be part of the gaming machine 202 or game server 205. Jackpot information is communicated to the slot accounting system to provide accounting and oversight functions. The jackpot controller 207, gaming machine 202 or the game server 205 may be the source of progressive gaming related information.

In a thin client embodiment, the game server 205 implements most or all of the game played by a player using a gaming machine 202, including the selection of the outcomes, and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components. In a thin client application the jackpot controller would be part of the game server. In this embodiment the game server also operates as the source of progressive gaming related information.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

During operation, the game controller, whether implemented in a stand alone gaming machine 10, 100 or over a network 201, implements a wagering game wherein a prize is awarded to a player based on the game outcome.

An example of a specific implementation of the gaming system will now be described in relation to a stand alone gaming machine 40, 100, although it will be understood that implementation may also be carried out using other gaming system architectures such as a network architecture of the type shown in FIG. 5.

In a thick client embodiment, a game server implements part of the game played by a player using a gaming machine and the gaming machine implements part of the game. Typically, if the gaming system enables players to participate in a progressive jackpot game, a jackpot controller will be provided to monitor and carry out the progressive jackpot game.

In a thin client embodiment, the game server implements most or all of the game played by a player using a gaming machine and the gaming machine essentially provides only the player interface.

Servers are also typically provided to assist in the administration of the gaming system 10, including for example a gaming floor management server 208 and a licensing server 209 to monitor the use of licenses relating to particular games. An administrator terminal is provided to allow an administrator to monitor the network and the devices connected to the network.

The gaming system 10 may communicate with other gaming systems, other local networks such as a corporate network, and/or a wide zone network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server could run a random number generator engine. Alternatively, a separate random number generator server could be provided.

In order to distribute progressive jackpot information generated by the gaming machine 10, 40 or system 100, 200, such gaming information is output, received by the combiner 312 and inserted into a video signal as closed caption data to produce a combined video signal. The combined video signal is distributed to one or more receivers for display of a video image which comprises the information as closed caption text.

The server 302 may be in the form of a dedicated progressive gaming related information server, which is configured to accumulate progressive gaming related information in the database 304 from a number of sources, such as those described above. The dedicated server may prioritize or schedule the order of output of the data indicative of the progressive gaming related information to the combiner 312. For example current winning bingo or Keno numbers may be periodically displayed as closed caption text along with a current progressive Jackpot total. This sequence may be interrupted if the Jackpot is won. Information on the win and congratulatory messages may be displayed for a period of time before resuming the prior sequence of progressive gaming related information. The present invention provides a convenient system and method of distributing progressive gaming related information for display.

Modifications and variations as be apparent to a skilled addressee are deemed to be within the scope of the present invention.

The invention claimed is:

1. A method of distributing progressive gaming related information from a gaming system that is configured to receive a wager and in response, to provide at least a primary game of chance and a secondary game of chance that is independent of said primary game of chance, the gaming system having at least one receiver for display, the method comprising:

retrieving data indicative of progressive gaming related information of said primary game of chance from the gaming system in a first format;

processing the retrieved data to determine if the retrieved data needs to be converted into text information, and based on said processing, converting the retrieved data from said first format into text information;

inserting the converted text information into a video signal as closed caption data to produce a combined video signal, wherein said combined video signal is configured to facilitate play of said secondary game of chance; and distributing the combined video signal to at least one receiver for display of a video image which comprises the converted text information as closed caption text so as to facilitate play of said primary game of chance concurrently with play of said secondary game of chance.

2. A method according to claim 1, wherein the gaming system has a plurality of gaming machines, and wherein said retrieving data indicative of progressive gaming related information includes retrieving data from the plurality of gaming machines.

3. A method according to claim 2, and further comprising extracting progressive gaming related information from a data signal and inserting said progressive gaming related information into the video signal.

4. A method according to claim 2, and wherein the progressive gaming related information comprises one or more of: jackpot information, game results, congratulatory messages for game winners, and game scheduling information.

5. A method according to claim 1, and further comprising displaying the video image according to the combined video signal.

6. A method according to claim 1, wherein said gaming system includes a video signal source, and the method further comprising receiving the video signal from the video signal source.

7. A system for distributing progressive gaming related information for at least a primary game of chance and a secondary game of chance that is independent of said primary game of chance, the system comprising:

a server configured to retrieve data indicative of progressive gaming related information of said primary game of chance in a first format;

a combiner configured to 1) process the retrieved data to determine if the retrieved data needs to be converted into text information, 2) convert the retrieved data from said first format into text information, and 3) combine the converted text information with a video signal so as to produce a combined video signal, wherein said combined video signal is configured to facilitate play of said secondary game of chance; and a communications medium configured to distribute the combined video signal to at least one receiver for display of a video image which comprises the converted text information as closed caption text so as to facilitate play of said primary game of chance concurrently with play of said secondary game of chance.

8. A system according to claim 7, and further comprising a source of the data indicative of progressive gaming related information.

9. A system according to claim 8, and wherein the source includes a plurality of gaming machines, and wherein the gaming machines are configured to form the progressive gaming related information in a format suitable for insertion into the video signal as closed caption data prior to outing the data indicative of the progressive gaming related information to the combiner.

10. A system according to claim 7, and wherein the combiner is configured to to extract the progressive gaming related information for insertion into the video signal.

11. A system according to claim 7, and further comprising a source of the video signal.

12. A system according to claim 7, and further comprising at least one receiver, said at least one receiver comprising a display for displaying the video image according to the combined video signal.

* * * * *